US006320515B1

(12) United States Patent
Olsson

(10) Patent No.: US 6,320,515 B1
(45) Date of Patent: Nov. 20, 2001

(54) METHOD AND EQUIPMENT FOR MOTORWAY CONTROL

(76) Inventor: Kjell Olsson, Saningsv., 175 52 Jarfalla (SE)

( * ) Notice: Subject to any disclaimer, the term of this patent is extended or adjusted under 35 U.S.C. 154(b) by 0 days.

(21) Appl. No.: 09/242,027

(22) PCT Filed: Aug. 7, 1997

(86) PCT No.: PCT/SE97/01331

§ 371 Date: Feb. 5, 1999

§ 102(e) Date: Feb. 5, 1999

(87) PCT Pub. No.: WO98/08207

PCT Pub. Date: Feb. 26, 1998

(30) Foreign Application Priority Data

Aug. 9, 1996 (SE) ..... 9602950-9

(51) Int. Cl.[7] ..... G08G 1/09

(52) U.S. Cl. ..... 340/905; 340/907; 340/911; 340/917; 340/918; 340/919; 340/934

(58) Field of Search ..... 340/905, 907, 340/917, 909, 910, 911, 916, 918, 919, 920, 922, 924, 933, 934, 935, 936, 937, 938; 701/117

(56) References Cited

U.S. PATENT DOCUMENTS 4,727,371 * 2/1988 Wulkowicz ..... 340/917
5,283,573 * 2/1994 Takatou et al. ..... 340/937
5,396,429 * 3/1995 Hanchett ..... 340/937
5,444,442 * 8/1995 Sadakata et al. ..... 340/916
5,583,792 * 12/1996 Li et al. ..... 340/907
5,610,599 * 3/1997 Nomura et al. ..... 340/931
5,822,712 * 10/1998 Olsson ..... 340/934
5,917,432 * 6/1999 Rathbone ..... 340/907
5,999,877 * 12/1999 Takahashi et al. ..... 340/905
6,204,778 * 3/2001 Bergan et al. ..... 340/936

* cited by examiner

*Primary Examiner*—Nina Tong
(74) *Attorney, Agent, or Firm*—Connolly Bove Lodge & Hutz LLP

(57) ABSTRACT

The method and the means concern a system for control of motorway traffic, with focus on access control. The network characteristics of the traffic, according to the invention, is treated by traffic control functions based on the traffic as well as the access itself, as at the closest section upstream the access, and at connected parts of the road network. The invention goal is safer traffic and an effective utilization of the motorway. The system is creating possibilities for a dynamic traffic management with control of traffic flows. A smoother and better controlled weaving process is effected by preparatory actions and the functions create more margins, as well in space as in time, for the performance of the usually complicated and dangerous driving procedures on the motorway. Modern information technology is used as a means for carrying out the invented solutions.

14 Claims, 1 Drawing Sheet

METHOD AND EQUIPMENT FOR MOTORWAY CONTROL

BACKGROUND OF THE INVENTION

Figure 1:
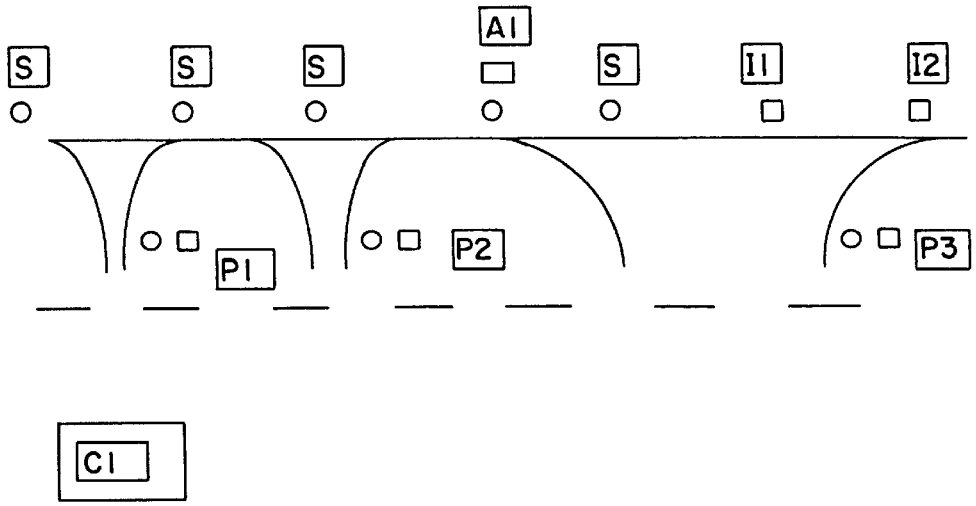

Short Information about the Invention as System Controlled Access (SCA)

The system controlled access is designed by several coordinated steps. Actions are taken at the road net on different distances from the given access point. Far upstream, traffic control actions are introduced, that e g might limit average flows in to SCA, i e for an average time period, some minutes or less, a controlled amount of cars will arrive. During the travel towards the motorway access, those cars however might pack together to various dense "car-packets", which implies that during short time periods of less than a minute, large differences from the average flow might arise. Those differences have to be considered at e g closer positioned accesses, not allowing many cars at the access at the same time as there are a package of dense traffic on the motorway. Otherwise all the cars haven't space enough for weaving, and the traffic collapses resulting in queue build up and high risk for accidents.

By regulating the access traffic in relation to the motorway traffic, the traffic density is smoothed for the downstream motorway link. However there are many factors working in the opposite direction, why traffic successively will distribute according to statistical distributions. Thus one might measure a certain traffic distribution at one spot on the motorway, which is different from the traffic distribution some kms further downstream. Differences in detailed traffic distribution arise also if there are no access or exits in between. That means that one often has to consider newly and closely arisen variations, when striving for an effective traffic control.

So there is also a need for a final control at the waving area to achieve a safe and efficient traffic access. An important part of the invention considers that last phase of the access control.

The invention can be regarded as a system of actions on four different levels. The first level is "Access control along a motorway" and is based on traffic management of a road-network, considering various access roads, as other motorways, connections to city street-network etc.

The second level is "preparatory weaving", which is performed on the motorway upstream exits and access-roads.

The third level is "preparatory actions", which are performed just before the "ramp".

The fourth level is the "local level" at the position of the ramp.

The four levels can work together and combine to an efficient and safe access traffic. But compared to to-day situation, every level by itself can be implemented resulting in improved access control. The invention concerns a system-based improvement of access traffic control, where the different levels can be implemented one by itself, or in combinations to various extent, or successively at different occasions, possibly as steps in a planned expansion, or within a given short time period to obtain a more direct cooperation of the applied levels.

TRADITIONAL ACCESS CONTROLS

The most used on-flow "control" is free weaving of traffic from the access road into the motorway, but with certain rules giving the motorway traffic priority, i e the cars from the access-road should adapt and weave into the gaps between the cars of the motorway. When the traffic flow on the motorway is close to its maximum, there aren't enough safety margins to put cars into the small existing gaps. If a car anyhow turns into such a gap, the driver wants to start braking to increase the distance to the car in front of him.

The car behind, then has to brake even harder, partly because his gap shouldn't decrease and partly because the distance gap was too small already from start. Simply said, the braking need has doubled. Then if more cars are weaving into gaps between the following cars already braking to keep their safety distances, then the result soon turns into a traffic collapse with queue build up and large risk for accidents. Similar collapses occur also when the motorway traffic is less dense, but the access traffic flow is higher, giving the total flow above the access weaving capacity.

TRADITIONAL "RAMP-METERING"

The concept of ramp-metering is often described as a way to limit the access flow to the ramp, not allowing more vehicles to enter than what gap space there are on the motorway. When there are periods with lower traffic flow on the motorway, more cars can be allowed to access, and if it is very dense traffic on the motorway, no cars are allowed and so on. The access is regulated by traffic signals. If there are too many cars in a row on the access road, they will be lined up in queue, and one car a time is allowed, when the traffic light signal turns green for some second.

The problem with ramp-metering is that it is not operating that well adapted to the traffic. Certainly the motorway is equipped with sensors, positioned just upstream the ramp (e g a couple of hundred meters) and thus measure the traffic at that position. But there are two problems, when one wants to utilize those measurement values for controlling the access traffic. One problem is usually too long measurement periods e g a minute. That implies that before the measurement period has ended, the first cars have had time to run for almost a minute, meaning that they have passed a distance of 1800 m ($L=v*t$) at a speed of 110 km/h. Most of the cars thus have already passed the weaving area before even the measurement period has ended. That measurement intended for giving knowledge about how many cars, that are on their way to the weaving area, for the intended succeeding control of the ramp-meter according to just that traffic. The other problem is that the light signal has to be positioned far upstream on the access road, giving the stopped cars a long enough distance of acceleration to reach the speed (110 km/h) of the motorway traffic. They should have the same speed as the motorway cars to be able to weave into the motorway traffic in a smooth safe way. It means that controlling the ramp-meter according to the measured values, it will take further some 20 to 30 seconds ($t=v/a$), before the access road cars have reached the weaving zone, i e the traffic, that now is on the motorway, is quite another traffic than has been measured, and the measured traffic has already passed.

Thus the measurement should be carried out at least the distance $L=v*t=v*v/a==v^2/a$ upstream of the weaving area.

It seems that those traffic engineers that use ramp-meters, haven't understood the problem. Accordingly there are some secret magic about those algorithms and methods used on the measured values to optimize in what time period the cars should be allowed to pass the metering signal. Generally the methods also use more than one measurement period value, to reach their results, which means that they are trying even harder to adapt the access traffic to that traffic on the motorway that have passed since still longer time ago.

OTHER KNOWN TECHNIQUE

In the Swedish patents 9203474-3 and 9501919-6 methods are described for predicting traffic and detecting incidents and traffic collapses. Those methods are generally applicable for traffic management on the whole road network, and are also useful at access control. Those methods are postulated known, and when prediction and queue-detection etc are mentioned in connection with the present invention, those methods are good examples of how to perform such matters.

Access control by ramp-metering has been used for a long time period, not least in U.S. The methods have their deficiencies and is generally not really operating in that way as it is described. That was described in the section Traditional "ramp-metering". Here we shall discuss some chosen known examples on methods, which have been suggested for use in connection with access roads and lane changes.

There are ideas on building "car-trains" or platoons of cars on motorways for increasing the capacity very much. The cars are going to be automatically controlled, driven very close to each other (e g a meter), and be using an advanced mutual communication of data. The vehicles will be electronically connected to a train, which is supposed to travel very fast and safety. Also the processes of leaving and joining a train will be complicated, as well as changing lanes among automatic trains or platoons. This is supposed to be handled automatically by interactive communication between neighbouring cars, that negotiate for allowance and support from others for performing the desired actions. Standardized communication protocols are suggested for the automatic process.

At the access to an "automatic motorway" the cars are sending information about their destinations and are receiving detailed journey plans from the "road-based system". Those plans are then automatically followed by all the cars all the way to their respective off-roads from the motorway.

The present invention has another function and is primarily created for driver-controlled cars. So the inherent functions are open for differencies in driver behaviours, and takes into account the natural statistical variations in traffic. The basic parts of the invention can be applied with to-day cars, and is not requiring the advanced vehicle systems and methods, which are needed for the ideas of "car-trains".

In the patent DE1943596 A1 a method is described informing car drivers on recommended positions along the lanes. A light-line is presented in front of and behind the car. In the position the car should be, a gap is given, i e the light-line is off in this interval. The off-light gap is moving forward with that velocity the control system is determining. The presented design with the light-line position in the middle of the lane, makes an impression of being expensive, brittle, expensive to maintain and giving failure mode problems, as non-desirable gaps are given, wherever any part is broken.

The described access control is treating situations, when the flow of the motorway and the access road together is low enough giving a total flow below the capacity of the motorway. Then that invention might somewhat correct the relative positions of the cars in such a way, that cars are not reaching the weaving point at the same time, but with acceptable gaps in between. To-day that process is performed by using a ramp, where the cars on the access and the motorway are travelling several hundred meters in parallal, and the drivers are watching each other optically and controlling their speeds to adapt to the gaps between the cars before weaving.

The real traffic problem arises, when there are too many cars simultaneously on the motorway and the access road. The problem might arise already for very short term flow peaks (one or a few tens of seconds). This is usually happening at rush hours at large cities. That DE-patent is not solving this or other problems. However the traditional ramp-metering is a trial to treat that problem, and the present invention gives solutions on that and related problems.

In a patent DE4238850A1 a method is described for informing drivers on two lanes how to weave, when the two lanes turn into one lane. It is proposed to be done with a sign, showing a surveillance model image of several car positions in respective lane during the weaving phase. The image is illustrating the weaving for a time sequence of several frames (7). It is an obvious problem for the driver to understand which car is his, and then to understand what to do accordingly. This is a general problem, when one wants to present selective information to individual drivers. How to tell one individual that it is just for him the message on the sign is directed.

In the present invention methods are given where this problem is solved.

THE BASIS FOR THE PRESENT INVENTION

To achieve a good solution for access control to motorways, a wholistic process, a system solution, is needed. In its first place, it is not evident that one always should allow as much traffic as is possible from an access road to a motorway. It might imply that the motorway is almost filled up by traffic at the next downstream access, why one at this later access, cannot allow that amount of traffic one wants and that is needed to avoid long queues and large traffic problems at the neighbouring road network.

During morning rush hours the traffic grows dense on the access roads closer the town city. It means that the risks for traffic collapse and queue build up is larger closer to the city. To-day it is regularly long queues on the entrance routes of the large cities of the world. Usually the queues are causing larger problems the closer the city they are. The reason is that the road network is more dense there with more roads and with larger flows of traffic connected to each other. A queue that build up on one road, is easily growing backwards to connected roads, and is there blocking or reducing the passability also on those roads, which in its turn causes even faster queue build up on those roads and fast spread of queues further across the road network and so on. It is not unusual with large network areas of reduced traffic capacity, caused by traffic flows unnecessarily blocking each other by queues.

From traffic management point of view, it might be much more beneficial to distribute the traffic, in such a way, that queue build up to a larger extent is occurring at the more peripheric areas, where the added blocking effect is less. By that the total queue time can be reduced, and in several cases the traffic situation should be remarkably better, and the queue build up almost disappear. A tool for achieving such positive effects is obtained by the "System controlled access, SCA", which takes care of the large scale functions described above and also the detailed access control including the design of ramps and equipments for more efficient and safer motorway access processes.

An example on increased safety is obtained, offering the drivers help from the system, defining and appointing certain driver roles in the traffic interaction processes. To-day it is required that the drivers mutually agree on the way to interact e g agree on who to drive first, or who to let a car in, that wants to change lanes. Often the drivers have only a very short time for reactions, combined with poor possibilities for communications, why misunderstanding is easily turning up, causing dangerous situations. Traffic rules are helping of course, but they are difficult to evaluate in short time in complicated critical situations and borderline cases. Therefore the present invention also includes system functions and equipments for role identification and appointment.

FIGURE DESCRIBTIONS

The invention is shortly described with reference to FIGS. 1 and 2.

FIG. 1: A traffic management system is fed with traffic information from sensors, S, at various positions along the motorway, on accesses, P1–P3, and possibly at the connected road network N1. The management system might be more or less advanced. It might have functions for continuously calculating and predicting of traffic on the given road network. It might have analysis functions for comparison of traffic streams with travellers need for road capacity etc. During rush hours the capacity is many times inadequateat at several links and nodes at the road network, and traffic can be distributed in a way utilizing the road network better and reducing the traffic problems. Values on goals for traffic flows can be determined on motorways and access roads. Goals can be determined adapted to various traffic conditions and be given certain values over the day. Those are values, that reduce traffic problems, if they are under control.

Access roads can be given flow rations, which prevent overloading along the motorway. The goal values might be regarded as average guide-lines. In reality the traffic is fluctuating and short term variations of the motorway flow might be measured at the nearest upstream S and/or at the exit in A1, and be used by the local access control at P3, for dynamic correction of the onflow in relation to the ration. The correction is determined in C1, P3 or A1 and should be based on a prediction of the flow at the access, knowing the upstream measured result.

The distance L1 from upstream S to the access, must be long, as the onflow control requires time for actions. That means that there will be a need fo correction of traffic density, gap distances, of the motorway traffic travelling to the weaving zone. Information considering gap distances is given by the information means I1.

Finally the system can be expanded by adding weaving information by I2, which informs individual cars about their respective roles in the weaving process. That will reduce insecurities and risks in the weaving process.

Figure 2:
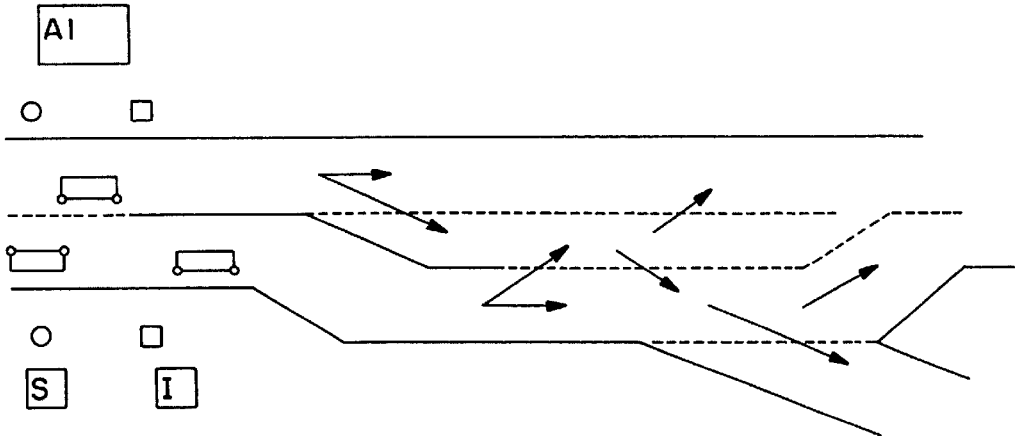

FIG. 2 is a diagram of the exit control, with the introduction of a "Middle lane", Me. To the left, upstream in the figure, there are three cars illustrating the intention of changing lanes. The car in the left lane indicates that it will turn to the exit. The first car in the right lane also wants to turn. The other car wants to change to the left lane. The small circles at the front and back of the cars illustrate activated blinkers.

Arrows in the lane show how the cars change lanes and how the cars in the right lane alternatively turn to the exit or continue along the motorway, where Me and the right lane join to continue as the right lane.

The exit equipment A1 has sensors, S, which detect turning information of the cars, and information means I, which inform the cars about their roles including assigning of lanes. A1 delivers information about the motorway flow, based on how many cars, that turn, and that information is utilized for correcting the goal flow, the ration, at downstream access control.

DESCRIPTION OF THE INVENTION

From traffic management point of view, we want a controlled distribution of the access traffic along a motorway. Assume that we have got a situation with increasing traffic towards the city, and that we have got an access road (P3), where traffic regularly is collapsing at the morning rush hour with long queues as the result. A traffic management system analyses the traffic situation on the road network, and produces a desired distribution of the access flows of the different accesses. The requirement is also to avoid queues on the motorway, i e extraordinary large traffic flow peaks should primary be taken care of at the access roads. The given access (On0)is in this example the narrow section, the bottleneck that traffic has to pass before spreading out through the consecutive exits.

Consequently there is an updated access control setting, as a basis for every access, and that control is giving the desired traffic distribution and is preliminary bringing the bottleneck at (P3) being passable by the motorway traffic without collapsing into a queue.

The SCA operates from an upstream access (e g the third, (P1), counted from (P3) in the following way.

A traffic signal at the access road is given a first setting, that limits the access flow to the given predetermined value. Measurements and controls are performed based on a relatively short measurement time period (t1), less than a minute. If the access demand is lower than the predetermined value during the time period, the extra flow is given as an additional flow portion to the closest downstream access or the access that needs it more. If the motorway flow instead was larger than the predetermined value, the result might be larger total traffic volume after the access, and the succeeding access and/or accesses further down, are then assigned corresponding decreases of their allowed access flows. In this way the deviations from the goal value are corrected successively along the motorway, and downstream accesses (p2 to P3) are successively given information about what traffic flows can be expected and what corrections to be done from their assigned access flow ratios.

There are generally two reasons for arisen deviations along the motorway. One reason is the deviations in exit traffic between two access road. The other reason is deviations because traffic is bunched together in various ways, especially pronounced for long distances between accesses.

At upstream accesses the total traffic inwards city is generally remarkably lower than the capacity, also when there is some extra traffic. So we study (P3) more carefully, as this is the narrow seciton, where it is desired to pass the maximum flow, i e utilizing the maximum capacity.

Now there is a traffic management system, which controls that traffic going in to (p3) in average is at the right level, both on the motorway and the access. Let us also assume that there is a queue on the access road, why there is a need for utilizing the max capacity during the "study period". The first problem now is that the motorway traffic isn't absolutely known in detail, when allowing the cars at the traffic signal at the access road. There are packets with a bit more dense traffic and there are packets with less dense traffic. If now cars are allowed from the access road according to the average distribution, there is a risk for traffic collapse, when there are dense packets on the motorway, and not completely utilizing the full capacity, when there are less dense packets. The more knowledge about the traffic long enough in advance, the closer the traffic flow can be matched by the traffic signal control.

PREPARATORY ACCESS CONTROL

If the closest upstream exit is positioned that far upstream, that a measurement on the traffic can be obtained in time, before the related access traffic has to be allowed by the traffic sign, then very much would have been achieved. A design of the road network structure considering this matter, would be helpful, where it can be implemented. The present exits and accesses are not always fulfilling that requirement.

A measurement of traffic using short measurement periods at exits is anyhow giving opportunities, in second hand decreasing the access flow, not to make packed traffic ahead worse, by further adding of access cars.

A measurement of traffic just before the access connection (some hundred meters) might be valuable for controlling the the final part, the actual weaving process.

There is a possibility to design the ramp, giving the car on the ramp information, before weaving, about not continuing for the weaving, but continuing along the ramp, turning off into an exit road going back for a new trial.

It is remarkable that dense traffic motorway ramps haven't that opportunity already to-day. There are arisen dangerous situations already, when cars on the ramp don't find any suitable gap, and are breaking to find a late gap, which might not arrive. When the end of the ramp is close, the driver is caught in a dangerous situation, where he is throwing his car into the motorway, - often into a too small gap and with a different velocity, or he might continue on the road shoulder. It might work out for this driver. But there is no guarantee, that it will work out for the followers. The result is often sudden brakings on the motorway, which in turn might cause accidents. Implementing a return road from the ramp, thus would be another action offering help in the traffic management work.

The weaving process is in itself a risky process, especially when one wants to utilize the capacity at maximum. The margins then will axiomaticly be correspondingly small. Tools facilitating that process imply more safe and more efficient weaving. The following theoretical reasoning is a pedagogic example. Imagine the motorway and the access consisting of small platforms carrying respective car, and a mechanical system managing the movement of each platform. Then it would be a simple controllable task for a system to successively adapt velocities and gaps of the platforms in such a way, that weaving the platforms from the motorway and the access, would be carried out in a very safe and efficient way.

In the following we shall describe methods, which are of help to create a process that is reaching further towards the described theoretical example than what the established access processes of to-day are doing. Instead of mechanical movement systems we will use information technology as tools.

For synchronizing the motorway traffic and access traffic, one way is to identify, for each access car, that motorway car (B), which is to let in the access car (A). Also there are installed signal means at suitable intervals along the motorway and possibly the access. Those means can be designed in various ways and be positioned in various ways e g hanging above the road, attached to poles at the roadside etc. Here a design is described in more detail as an example.

On poles, similar to road signs, information signs are put along the motorway. They can be turned on and off and possibly change information. They are screened and directed backwards to the traffic flow. They shall be able to switch on, when the car ahead of (B) is no longer seeing the information, and be on as long as (B) sees it. Successively the next sign is switched on and so on. The signs can be positioned more or less dense on such a distance, that principally one sign is always on and can be read by (B). The car (C), which is following (B), experiences that the signal is not meant for (C), as the sign is turned off when (B) cannot see it any longer, which is at latest when (B) is passing the sign.

Information in a simple design, can be a lamp, which is on for (B), when (B) should decrease his velocity, either for increasing the distance to the car ahead or for adapting the arrival time to (A)'s arrival time to the weaving zone. Car (A) also might get corresponding information, meaning reducing his velocity for avoiding running away from his "gap". It is not always easy for (A) to do a final correction, while driving in parallall with the motorway, and perhaps not even seeing if he might be too far ahead or back.

There are respective measuring means on the motorway and the access road. By help from those the (B) -car is selected due to the predicted arrival times of the cars. This process performs close to what our theoretical mechanical model was doing. There are however various possibilities to improve the function.

Instead of just switch on and off a lamp, information can be made more clear. It can be symbols, describing how much the gap has to be increased to the car ahead, possibly related to the desired and present size, e g by a line-symbol of the desired gap, wherein the position of car (B) is included with a symbol, possibly with "alarm information" (blink, colour, arrow, lined area etc.), amplifying the need for action. One can show that a car will weave in front of (B) in different ways e g with a symbol arrow into the gap between (B) and the car ahead, possibly can a model of the access ahead be shown, including coloured arrows showing (B) and (A) travelling towards the weaving zone, and (A) turning into the gap in front of (B).

One can give dynamic velocity information possibly also to (A), managing the cars to a synchronous weaving. One can add text. It is important that information is easy to apprehend quickly and without misunderstanding. At dense traffic the time gaps between cars are small, about 2 seconds, which isn't much time to grasp the information. When the gap is increased to 3–4 seconds to let a car in, the distance will be about 100 m (at 110 km/h), which on the other hand is a long distance for seeing detailed information. Therefore it is better there are successive information means ahead, that are successively turned on and create a kind of repeated information to (B). One can utilize the road surface upstream the access point to mark the recommended gap between the cars e g by arrows, lines etc. They can be painted on the road surface. Usually one should be able to see two marks, while a car in (B)-position should be able to see three marks, possibly the design includes interchanging each other mark to look alike. Then (B) would find his gap more automatic without the need for "counting" marks.

Instead of the roadsign type of information, one can design the information presentation using searchlight, lightening the road section in front of the given car. The way of lightening the roadsurface, possibly with sweeping light, and possibly with light reflecting marks on the roadsurface, offers possibility for the driver to obtain information straight ahead from that area which he anyhow has got in his natural view.

Cars equipped with ICC, Intelligent Cruise Control, or distance keeper to the car ahead, can obtain information directly to the car equipment, that they are e g (B)-car and what distance to select and also the velocity. That equipment can present and/or automatically bring out the required gap ahead of the car.

A safety increasing effect is also obtained by lowering the speed. Above we saw the problem of short time for performing control, as results of measurements. The cars had time to run far with 110 km/h. Lowering the speed is suitably performed dynamically, when traffic on the motorway is getting dense. Lowering levels down to 70 or 50 km/h, is performed in the usual way in steps. The position of the access control signal can then be chosen remarkably closer the wearing zone, and the measurement on the motorway and the sign means can also be placed correspondingly closer to the access point. The adaption of gaps, which now can be shorter, and the weaving process can be performed at a more calm speed. The following is suggested for using dynamic velocity adaption. The speed on the motorway is high at free flow and less dense traffic e g during most of the day hours. The suggested tools are used when suitable. At more dense traffic the velocity is decreased and the given tools being adapted to this situation are used more fully.

Detecting the car positions can be done from the roadside, possibly combined with the signal means. It can be performed by known types of sensors. One can also use simple sensors, which only detect cars passing and thus trigger the signal means "on and off". They can also simply measure time gaps between cars and by that survey the adaption of the gap. When car (B) is defined, there are simple methods to survey the process down to the access point. A method is based on prediction when car (B) will reach a certain position. Corrections of predictions can be done successively, dependent on measured deviations from the predicted values. Applying said methods, one can make preparations in time before arriving to the ramp, for allowing an access car (A) to weave in ahead of a motorway car (B). If starting at about 660 m upstream, the (B)-car has got 20 s, and then the (A)-car also has got that time for his last part of transportation to the weaving zone. Lowering the speed, the cars would have more time to use, and then their respective distances can be decreased. One way doing the final choice of (B), would be first allowing (A) to pass for the access, and then measuring the status of (A) at an intermediate station and from that predict the arrival time to the weaving zone, and thereby also select the suitable (B)-car. The allowance of the (A) car to pass, is determined from still further upstream measurements, offering a predicted average density for a short time period. Within such a defined short time period car packet, there is space for an (A)-car, seen over the whole packet. The methods above, are aiming at distributing the gaps between the cars in a bit different way, giving a real space for (A), when (A) and (B) are arriving to their weaving zone.

That should also be performed in a smooth way, not risking that the follower car (C), is running into (B). Simplifying for (C) and also other following cars, those cars can also be given information about e g braking to keep a safe gap the car ahead. An alarm signal, informing about the activity of the car ahead in the preweaving process, can contribute to an increased safety.

Car (A)-control

Car (A) can also be given a more accurately controlled transport by obtaining a successively updated information about desirable changes to synchronize to the weaving gap. In present systems cars (A) have relatively large individual differencies in travel times form the ramp-meter signal to the weaving zone. It is because the acceleration is carried out by large individual differencies. Also the performance of various vehicles e g heavy trucks, play a role. It implies that also when the (B)-car is accurately controlled, regarding its adaption of the gap distance, the (A)-car might arrive far ahead or behind the created gap.

In one embodiment of the system, the (A)-car is given successive information about its relative position related to the expected gap. One might e g show two parallall lanes, where the expected gap is marked static on the left lane, and the predicted final position, based on actual velocity status, on the right lane. A line from the middle of the gap, across the right lane is marking the target line. The symbol of the car (A) might e g shine blue with an arrow up towards the gap line, when the relative position of (A) is predicted to be behind the gap. While if (A) is presented ahead of the gap, the symbol is shinig yellow and the arrow is pointing downwards. When the (A) is indicated just across the gap, the symbol is shining green. An arrow also on the green symbol indicates that (A) should change his velocity accordingly, for keeping the position.

Principally the tasks can be divided, giving (B) the main task creating the gap, and (A) the task adapting his arrival time to be in synchronism of the gap.

Standardizing the velocity process for the access cars, there would be gain, as the drivers successively are learning to follow the given rythm.

Another way to see the need for control of (A), is by watching the flow of (A)-cars. At dense motorway traffic, one perhaps let through 600 cars/h, i e one car each 6 seconds. Then it is 12 seconds between a first and the third car. That time difference might easily be absorbed by differences in acceleration, why the three cars might reach the weaving zone tightly together. Then there will be no space for all of them weaving smoothly. If the allowance of (A)-cars is even denser, yet longer platoons of (A)-cars might reach the weaving zone tight together. Thus it is not sufficient with the present ramp-meter system functions, for reaching a steady predetermined access flow to the motorway. There is a need for a complementary system. On the other hand, a dynamic management system for (A)-cars would replace the present stereotype ramp-meter system. Often the access cars would be managed up to the motorway individually matched, without any need for stopping at any red signal. A stop might be regarded as one of several steps of different velocities, included in the dynamic speed adaption.

Preparatory Weaving

Another type of preparation for downstream accesses and exits, includes the lane changes between the left and the right lanes of the motorway. The drivers regularly want to carry out those changes early in time. Weavings between lanes cause an increased accident risk and cause a decreased capacity for the road segment. Simply expressed, the car changing lanes needs reasonable space simultaneously in both lanes just while changing. There is a natural need for cars in the left lane to change for the right lane upstream the exit ramp, when they are going to leave the motorway. After an access there also is a need for cars going for a longer distance, to change from the right to the left lane. Then they avoid being involved in the near access processes. Also an effective dense traffic in the left lane is necessary, for allowing a maximum number of cars from the following access road, and offering the cars space enough for weaving into the motorway.

Special weaving zones might be designed at the mentioned road segments. There is one segment in the position between an exit and the following access, where it is advantageous to weave from the right to the left. There the exit has caused gaps, related to the cars that turned off. Then there are gaps in the left lane open for weavings from the right, while the right lane isn't completely filled up.

The extra capacity can be used for weaving to the left, increasing the possibility for added flow from the following access.

After an access and before an exit there are needs for weaving in both directions. Those who will turn off at the nearest exit and are driving in the left lane want to change to the right lane. Several of the newly accessed cars want to change to the left lane. If both lanes are utilized at a maximum, there are no space for weaving. However those cars going to leave are anxious to change, and then the risk grows large, when they force themself into too small gaps in the right lane. The process can be made safer by adding a special lane, an extra lane with related traffic rules. The extra lane is positioned between the left and the right lanes, by (easiest) the right lane bending out giving place for the intermediate lane (int). Continuous marked lines force the cars to stay in their respective lane as a start. Then leaving cars, (A)-cars, are allowed to change from left to int. lane. Before the shift such a car should indicate the shift by the right blinker. The car behind in the right lane, (B)-car, might indicate a shift to int. lane with his blinker and weave into int. lane after (A). Also the car after (B) can be given possibility to select int. lane, if he e g wants to weave further on to the left lane. The closest car, staying in the right lane, (C), has to watch for and keep the safe distance to his related car ahead, which now is in the int. lane. The car called (B), the follower, if aiming for the left lane now weaves into the gap; that has been obtained in the left lane by (A) leaving. The car that was behind (A) in the left lane, is keeping the gap to let in (B), or a follower from the int. lane (or possibly later on a car from the right lane). The (C)-car watches the safety distance to the car ahead in the int. lane. In the next phase, 2, (A) and possibly another car in int. lane weave into the right lane in the gap ahead of (C).

The rule utilized both here at an exit and at an access, is that the first weaving car (A), is supplying a signal (blinker). The car behind in the neighbouring lane, car (B), is responding with a signal and is turning after (A). The other cars keep their original safe distances, also if the car ahead now is in another lane, until the weaving process is ready.

Local Access Control

In the area, where the access road is connecting the motorway and (A) and (B) can see each other, there is a final correction of speed and distance gap to achieve a safe and effective weaving process. If the preparatory process has worked out well, there is not very much left to do. One might however consider further tools to make also this process easier, especially if the first step didn't work out quite good.

Below there are presented a number of methods and tools. Most of those can be of help, also if the previous methods haven't been used.

Signals for indications of the roles (A) and (B).

When (A) and (B) are seeing each other on the ramp, the access control system can help defining (A) and (B). Upstream the weaving zone, at the "isolated" part between the ramp and the motorway lane, where it is a line separation, it is shown for (A) and (B), possibly with a common sign, the own position related to the other's. (A) might be presented an arrow symbol, indicating where the gap and the (B)-car is positioned relative the own position, and by that identifying the actual gap and (B)-car.

Connected to the above method or as an alternative, (A) might take action to get the position (on the ramp) definitely ahead of that car, being a (B)-car, and after that giving signal with blinker, showing the desire to weave into that gap. The car behind replies with his opposite blinder (the right one at right driving), accepting the role as (B)-car.

As a continuation of any of the above methods, or as an alternative, one can regulate that (B), as soon as possible adapts to (A), and make the roles evident by the right signal, fulfilling the shift of lanes to the ramp. By that it is achieved, that first the weaving is performed to the ramp, where the traffic is not that dense, and that the (A)-car and the (C)-car easily understand, who is the (B)-car. Then (C) has got further time for expanding the gap to (B), without an immediate risk running into (B). Not until the end of the ramp, the "couple " (A) plus (B) is together weaving into the expanded gap on the motorway. (A) then has got time to get the right position for the gap, (B) to expand the distance to (A), and (C) as said, expanding the distance to (B). So at weaving into the otherwise dense traffic on the motorway, in this way a sufficient large gap has been created.

The ramp should with this method implemented, possibly be adapted by a design of two weaving zones. First an early one on the ramp, where (B) is weaving, then one more at the end of the ramp, where (A) and (B) are weaving. Further more weaving from the inner motorway lane to the outer lane (right) should be forbidden during the local and possibly the preparatory access control process. As a further safety action, the ramp might be designed with a returning road lane for those drivers on the ramp, which anyhow couldn't find their safe gap for weaving. Without the above presented methods and tools, i e as it is to-day, the returning road should be of still more help.

One more safety action is the introduction of dynamic speed control before the access. Finding that in spite of all actions, there will be problems, one can reduce the speed remarkably, and thereby decrease the risk for more serious consequences.

Examples on Related Exit and Access Control

Often the exit and access of a motorway are connected as a couple to other traffic links, with the exit generally upstream. The distance between the exit and the access might be relatively short, and there are advantages in utilizing the exit control also as as a preparatory access control. The following example is illustrating how that can be performed.

This example is similar to that described in "Preparatory weaving control" above.

As a start the exit is modified, utilizing the beginning of what later becomes the exist, as a third lane. The cars in the right lane will experience a lane division, where the system can distribute cars between the lanes. Cars in the left lane at this exit waiting to leave at the exit, signal as an (A)-car and shift to the int. lane, when (B)-cars or the system has prepared space in the int. lane. Cars in the int. lane, arriving from the right lane, are now given prepared space in the left lane. This is done by identifying certain cars as (B)-cars, i e such cars that should let in cars ahead.

At the end the right lane is divided into one link that continue as the ordinary exit, and another link that is combined with the int. lane, as a continuation of the ordinary right lane.

At the system estimation of the car density in the right lane, those gaps are included, that will arise after the weaving of cars to the left lane before the related access. Then for this access, the information that was obtained already at the exit, can be used for control of the access.

In this example, those cars are prioritized, that originally are in the left lane and are going to leave at the exit. For support in the weaving process, they ought to give signal early in time. The system can detect the signal and give support by managing the choice of the right lane cars for the int. or the right lane. Added to that there is the need for utilizing the left lane, to be able to achieve a maximum of space in the right lane, for the cars arriving at the next access.

Controls and Surveillance

When parts of or the whole system is implemented, there should be included an internal surveillance control function. Its task is registering from measurements the real result of the actions, for a successive updating of functions and algorithms, by which the system is adapting and improving. That can partly be done automatically built in the control process, and partly by the means of failure reports, alarms, statistical result reports etc.

The measuring stations, that are directly motivated by the purpose of control should be useful also for the surveillance function. However there might be a need for complementary measuring stations, e g after the ramp, which are delivering traffic status, showing the result of the access control, i e the effectivity and safety of the traffic out from the access process, and the traffic meeting the downstream strains.

There is also a need for using the consecutive measurements to detect, if and when the control functions after all, are not giving the required result. E g when the system from measurements is predicting (or detecting), that a (B)-car is breaking rules, not giving the required gap, or the (A)-car on the ramp having engine failure or is missing the arrival time, then a dynamic velocity sign decreasing the velocity before the weaving zone can be a measure to decrease the accident risk. Another measure can be interrupting the (A)-car's process and managing (A) back on the return road.

Examples on Embodiments

The system can be looked upon including four levels of actions as described on the first page, and one interesting example is the following:

Methods and means are implemented along a motorway in direction towards a city with principally increasing traffic closer to the city during the morning rush hour, where the system principally is using only level One for control of an upstream access, where the total traffic is relatively small, and the system is using principally combinations of level One and level Three for a downstream access, where the traffic is small and the requirements are large for a well flowing traffic, and when high effectivity is needed, the system can be complemented with level Two upstream this access, and in certain cases, the system can be equipped for the access with principally a combination of level One and level Four, and alternatively the system for the motorway can be introduced in various ways e g by using mainly only level Four or One on one or several accesses, and the system can also, when needed, be equipped for an access with all level, applied to an applicable extent.

Means and methods concerning level One, where the motorway and the access flows are controlled in relation to targets and rations for short and longer time periods, and for short time periods a corresponding packet or cars can be predicted to reach downstream accesses at earlier or later time stamps, and for those accesses, the allocation of access traffic can be corrected considering the upstream observed deviation, e g if there is observed a larger or smaller volume of cars travelling, the next following access, or if the need for compensation is larger for another access, that access is allocated a compensating ration, the traffic being successively readjusted along the motorway for those deviations, that anyhow can arise in spite of the control, especially seen over short time periods, and seen over longer time periods, two or more short ones, the respective access is obtaining compensating allocations, dependent on allocation deviations from earlier periods compared with the valid targets and rations, and the valid target and ration can successively be updated, alternatively automatically by the traffic management system, which is supplying input data based on the topical needs at the road network.

Means and methods concerning level Two, where the extra intermediate lane (Int) is implemented between Le and Ri lanes, and cars in Le, which are going to exit, (A)-cars, give signs e g with blinker, and the car behind, (B), in Ri is also giving sign and follows after car (A) on Int. and alternatively also the car (C) after (B) in Ri can be controlled, and the weaving zone for Int is utilized to prepare gaps for safer weaving, and the system can be expanded with one or more added functions, e g by information means controlling the choice of lane, e g Int or Ri, and e g identifying the (B)-car, identifying the (A)-car, alternatively by detecting the signal from the (A)-car, and e g using knowledge about this level Two process for prediction of downstream traffic for control of the following access.

Means and methods, where the system contributes in effectively packing the traffic in Le lane, by estimating short term traffic density from measurements, and from the result appoint (B)-cars in Le, which are given the task to take out gaps ahead, and that process can be prepared already before the weaving zone, and cars in Ri experiencing gaps for them in Le, can take on the role as (A)-cars, e g showing that with blinker, and if there is an Int lane, select that lane for further weaving together with (B) to Le lane, and if there isn't an Int lane they can directly weave into Le in the gap ahead of (B), and the system can be expanded with one or more added functions; as giving information for identifying also (A)-cars, and as giving information to (B) about taking out a suitable gap in front of (B), and as using knowledge about this process for prediction of downstream traffic for control of the following access.

Means and methods concerning level Three, where the system helps (B)-cars in taking out gaps, and makes adjustment of the related (A)-car control, by e g correction of the ramp signal status, or alternatively timely control of (A) for arrival to the weaving zone, or both in combination, or alternatively by timely control of (B) or (B) and (A) to synchronize the arrival to the weaving zone, and the system can be expanded with one or more added functions; as giving information also to cars behind (B) to handle the consequencies of (B)'s actions e g braking, and as providing speed adjustment with dynamic signs before the weaving zone, dependent on matters as traffic density or accident risk, and lane separation lines can be added for weaving control between the motorway lanes, e g not allowing weaving from Le to Ri next to and at the ramp.

Means and methods concerning level Four, in the case when car (A) has reached the ramp and is travelling in parallall with RI lane, car (A) is searching for a position in front of a suitable (B)-car, and gives signal with blinker, showing that (A) wants to weave, and (B) is answering with sign, e g the opposite blinker, and (B) is turning into the ramp after (A), and the car (C) in Ri after (B), is responding taking out gap to (B), and the ramp-lane is used for the process of taking out gap distances, (A) is adapting to his gap to the car ahead, (B) is taking out his gap to (A), and then (A) and (B) together are weaving into that gap in Ri, which has been prepared by (C), and this method is used when level Three has not performed the corresponding function, or it is used as a final step in combination with level Three, and the system is equipped with one or more added functions: as identifying (B) and showing it for (B), and as showing the relative position of the gap for (A), and as showing the situation for (B) including gap size related to appropriate gap size,, and/to the relative position of (A), and as showing for (A) that the weaving process has to be stopped, possibly with a reference to a return road.

Means, where the ramp is designed with two weaving zones, the first one concerns weaving of (B)-car to the ramp and the second one concerns weaving of (A) and (B) to Ri lane, alternatively designing the ramp with a return road for access cars or both those alternatives in combination.

means, where speed limitation is an added function in the system for selectable use on the levels Two, Three and Four, and the speed message can be static, e g valid for some time periods or dynamically changable, depending on time of day and/or traffic situation, the velocity being an essential parameter in the access control, and the speed information is given by the system in a certain design, as part of an integrated information, and in another specific design information is given indirectly, e g by symbols showing a car position relative a selected compared position e g the position of another car.

Means and methods, where the system is equipped with system and function control, including estimating the real result of what traffic might look like from measurements, and compare that with the target for the system processes, wherein there are included the use of rules, predictions and management, successively updating functions and algorithms, and/or detection of deviations, which indicate or are estimated to give rise to dangerous situations and possibly risks for drivers to break rules.

Means, where the design of the information presentation means, are given by the following alternative basic concepts; the means including simple symbol signs as lamps, turning on and off, prisms turning, etc. where the rule simply is that the car (driver) obtaining signal saying "(B)-car" is appointed (B)-car and shall fulfill his stipulated task; i e principally take out gap to the car ahead, offering (A)-car to weave into this gap, the (A)-car e g an access car, alternatively the means including more detailed information, using illustrating symbols, as e g arrows modelling a car from the right turning into the gap in front of the appointed car, alternatively with a more detailed information marking the gap in front of (B), and alternatively relating the gap to the actual gap or using symbols for increase or decrease of the gap size, and alternatively using symbols for limiting or decreasing the velocity, with the objective of changing the gap and/or the arrival time at the weaving zone.

Means, where the system controls the arrival time of the (A)-care at the weaving zone by using functions, where one alternative consists of a speed control of (A), including the speed value zero, and successively manage (A) from the start of the acceleration road segment to the weaving zone by information means, in an alternative embodiment the means includes a light source with a lobe successively swept in front of (A) at a smoothly increased speed, with (A) can follow in about the same way as following a car, or alternatively using marks at the road side, which successively are activated at the pace (A) should follow, or alternatively using speed signs with successively increasing speed, alternatively dynamically adjustable for correcting the position of (A) relative to the planned, or alternatively an embodiment, which will show if (A) is before or after the allocated travel plan by using alternative presentation designs e g a sign with lamps in a row and with different colours, where the intermediate lamp is showing that the car is according to plan, the low lamp that the car is below and needs to increase, and the upper lamp that the car is ahead and needs to decrease the pace, alternatively the presentation also includes an indication on the size of the need for change, and one can detail the process in different ways e g by showing to lanes on the sign with a gap ahead of a car (B) in the left lane and the relative position of (A)-car in the right lane, where a line from the middle of the gap across the right lane indicates an ideal position, and (A) can be marked with different colours if (A) is before, after or in the gap, and arrows can mark the need for change of size and direction, and the control of (A) can include a cooperation with the ramp-meter signal, which is controlling the starting time of (A).

Means, where the information means are designed including a light source e g a lamp lightening a selected part of the road surface in front of (B)-car or (A)-car, and the light source can be designed to have one or more radiation variables, as several colours, several lobes, controllable lobes, whereby a corresponding simple or integrated message can be transferred, and the system can be expanded including various surface conditions of the road, which transform or reflect the radiation from the radiator according to its characteristics, and the surface can be given different patterns or symbols, further increasing the the possibility for transfer of information to the car drivers, e g a symbol meaning increase of the gap, can be shown successively on the road surface in the driver's view e g within the same view covering the car ahead.

Means, where an (A)-car in the left lane is detected giving a signal e g blinker, which e g can be detected by a video-camera on the predetermined distances, where (A) is initiating change of lanes, and then the system can identify (B)-car and show the information according to some of the earlier described means, and for handling the selection of Int or Ri lanes, the system can be expanded with functions appointing by arrows the (B) route and the other cars' routes.

Means, where (A)- and (B)-cars are identified and appointed, and when return is going to shown for (A)-car, it is presented according to one of the following alternatives; e g before the weaving zone two, a radiation source is used for blocking the weaving by light on the road surface and/or showing the route direction to the right for the return, alternatively a sign is used, which is positioned along and in between the Int and Ri lanes, which in the ordinary case is showing direction left before the weaving zone two, but now is showing direction to the right, alternatively there is a sign with a cross over the ordinary information showing that weaving is no longer admitted, alternatively that sign might be part of the continuation of the signs, which have been managing (A) from the access start, and in an expanded alternative the cross over can also be performed along the whole access distance, when the system concludes that the weaving process should be interrupted, alternatively the signs are placed above the road, and another possible position is at the end of the access ramp informing about continued or interrupted process.

Means, where car equipment is used for transfer of information from the system to the driver, and the communication can be performed using various types of media, e g radio, light or infrared technology, and communication can be organized by road side, locally bounded links, or more area covering means e g cellular types of radio, and here the information is corresponding to the earlier described and is presented according to the rules for presentations in a car, which also creates possibilities to present information by sounds, avoiding disturbance of the driver's eyesight control of the traffic situation, and more information can be transferred to the car equipment, information in its turn processed by the car equipment for actions and for suitable presentation, e g related to other information for the driver.

Means, where the car is equipped with distance controlling equipment, which can be fed with information about distances and contribute in taking out gaps, e g the gap for the (B)-car, and the system can be expanded also for using the speed control of the cars, e g for control of the travel plan of the car, where e g already at the start of the access segment, the (A)-car obtains information for the whole travel process, and also along the road, the car can have one or more points of control for possible adjustments of the continuous travel, and further information can be transferred to the car equipment for further processing by the equipment.

Examples and Basic Concepts

In the above text several examples have been given on the access control. The purpose with the examples are illustrating the principal concept and the basic ideas. The details of the embodiments can be varied in many ways, which should be evident for one knowledgable in the field. Throughout the text there are used the notation "car" e g "show for the car". "information to (B)-car" etc. where it is understood that it is the driver of the car or possibly a receiver equipment in the car, which is the information receiver.

The patent thus concerns the principal concept, and examples on solutions are submitted, which are representing also closely related variants. E g the typical case is described; a motorway with two lanes, one direction, and right side driving. The invention however is possible to apply also on motorways with more lanes and left driving. Also other large roads, with one or more lanes will be applicable for most of the general concepts.

The patent application touches a field, which is very little developed, but very essential. The traffic management area is also very complicated, as the traffic is related in a network and single actions in one point, might often give rise to large problems at other places, than those ones considered. The access control, ramp-metering, which is used today have large shortcomings. That means that from today situation, improvements can be introduced on many different levels, which each one is an improvement, seen from the present situation, and thus each one can be implemented. The system has been divided into a number of levels, and can be implemented and expanded in various combinations. Also various accesses along a motorway, are loaded differently and have different needs for solutions, and not at least economic reasons, resources and timing imply different use of the system levels and variations as well in position and time. However, the combination of the system levels offers an integrated coordinated solution on the access control to a motorway, and the system is just such a network based solution that is needed, but up to now has been lacking within the traffic management area.

What is claimed is:

1. A method concerning systems for access control of traffic at motorways and larger roads, where the access flow is controlled by information means, which directly or indirectly influence the access travel of the cars, and where the flow size is determined considering the flow size on the motorway, and where cars (A) from the access road interact with cars (B, C, etc) on the motorway while weaving together the respective flows, comprising;

limiting the flow of A-cars on the access road by a given target value, an allocated ration, which is related to a target value for the motorway flow, dynamically correcting the said ration based on at least one of the following (a) and (b);

a. upstream measurements of traffic flow on the motorway, with a correction determined by the deviation between the said flow target value and said measured value, and where the said upstream measurement site is positioned a distance L1 from the access weaving zone, where L1 is that far, that flow-corrected access cars reach the motorway in time for weaving with those motorway cars, which have caused the flow correction, and where a target value for L1 is L1 $\geqq v^2/a$, where v is an applicable velocity value for the motorway and a is an applicable acceleration value for the access, and the qoutient $v^2/a$ is covering (is larger than) the corresponding quotient of velocity and acceleration values for most of the applicable traffic situations, b. at upstream exit, measurements on cars, which indicate exit, a roadbased equipment, which register information about the cars indicating exit, said information is used for estimating a correction of the downstream access flow, and the traffic density in the right lane of the motorway, on a distance L2 closest upstream the weaving zone for the access, where L2 is less than L1, is determined within a limit in accordance to that access flow, which is estimated for the weaving together with the said motorway traffic, including determination of target values for gaps between motorway cars, where said target values give a density between cars on the motorway, which seen over the corresponding access flow time period for two consecutive (A)-cars, is corresponding to an added gap for those motorway cars, giving space for at least one car, an access car.

2. A method according to claim 1, where the method includes a principal function, HF1, superior access control, which concerns an integrated access flow control for a plurality of accesses along a motorway, HF1 comprising:

selection of a plurality of accesses along a motorway, determination of target values for motorway flows and access flows along the motorway, whereby each selected access is allocated a dynamic ration of traffic flow for access to the motorway, measurements of flows by sensors on the motorway, which including the access flow gives the added flow downstream the access, comparison of the actual flow on the motorway obtained from measurement, and the corresponding target value, and at deviations larger then a selected level; a correction is made, Cu, of the flow ration for at least one of downstream accesses, where the flow is increased or decreased dependent on the upstream motorway flow being too small or too large, and there is a succeeding correction, C1, of the flow rations for accesses that earlier have been given larger or smaller rations than the given target values, a dynamically updating of allocated rations of accesses flows based on measured or predicted traffic situations, an updating of said target values based on changed needs at the road network.

3. A method according to claim 2, where the method includes a principal function, HF2, exit control, which concerns control of exit traffic and preparations for the following access, HF2 comprising:

the exit process is performed in at least two stages, a first stage upstream of the weaving zone, a second stage, the weaving stage, where exit weaving is occuring, and during the first stage, information is exchanged between cars and road based equipment, where cars are indicating turning to the right or the left, the road based equipment registrating the turning information about the cars, information is calculated or predicted on the resultant distribution of traffic flow, concerning primary the right lane downstream the exit, and is used for estimation of correction of the downstream access flow, estimation of information about which cars selected for which lane, the road based equipment informing cars selectively about respective allocation of lanes, before or at the latest in stage 2, and in the second stage, an intermediate lane is implemented, Int., between the two rightest lanes of the motorway, of which the most right one, Ri, at least partly might consist of the earlier implemented exit ramp, and the other, Le, also consists of the left lane of a motorway with two lanes, single direction, and the said road based equipment is informing cars selectively about respective role, including allocation of lane, during the first or at latest during the second stage, comprising;

cars in Le, which are going to shift to Ri, are informed about the role involving a direct selection of the Int. lane, and after that weaving to the Ri, cars in Ri, which are going to shift to Le, are informed about the role involving weaving to Int. and then further to Le.

4. A method according to claim 1, where the method includes a principal function, HF3, preparatory access control, which concerns traffic control upstream an access, HF3 comprising:

road based equipment, is supplying information to cars on the right lane of the motorway about gap to the car ahead, where the road based information means are positioned on the distance L2 or the distance between the related exit and access, and the gap information is based on the target value of the gap between cars in the right lane of the motorway, based on estimated access flow of cars from downstream access to the motorway, determination of the target value for the gap according to (a) plus at least one of the following criterias (b) to (e), (a). the target value shall give a density of cars on the motorway, seen over the corresponding access flow time period, which corresponds to an added total gap, which have room for at least one more car, an access car;

(b). a succession of cars are given the same information, corresponding to equal gaps, (c). dedication of gaps for cars in a row, where the first one or few first cars are allocated larger gaps than the next followers, and the first cars are selected to match the later weaving by an access car, (d). the target value is selectively chosen from (b) at large access flows or long distances down to the access, while (c) is selected at smaller access flows or at short distances down to the access weaving zone, (e). the target value for the gap is dedicated to the car (B) on the motorway, which is selected to let in a car (A) from the access, comprising;

successive detection and registration of cars (A) on the access and cars on the motorway, prediction of when (A) reach the weaving zone and selection of the car (B) on the motorway, which is predicted to reach the weaving zone next after (A), selective information to (B) about the gap for letting in (A).

5. A method according to claim 1, where the method includes a principal function, HF4, local access control, which concerns control at the local access, HF4 comprising road based equipment, which detects and registrates cars (A) on the access and cars (B) and (C) on the motorway upstream the access, where the car (B) is the car on the motorway which is going to let in car (A) ahead, and car (C) is following (B), prediction of (A)'s and (B)'s travel towards the weaving zone, whereby the selection of (B)-car is based on the said prediction, road based equipment, which upstream the weaving zone, is informing the (B)-car about its role in the weaving, comprising at least one of the following method steps;

(a). informing about the role weaving together with (A) in position upstream (A), (b). informing about the role carrying out lane-shift to a position behind (A) in the ramp-lane and (B) following (A) to the weaving to the left, i e back into the gap, which (B) left on the motorway, (c). in addition to (b), informing (C) about the role meaning keeping the gap to car (B), also while (B) is in the parallall lane relative to C.

6. Means for carrying out the methods according to claim 1, concerning systems for access control of traffic at motorways and larger roads, where the access flow is controlled by information means, which directly or indirectly influence the access travel of the cars, and where the flow size is determined considering the flow size on the motorway, and where cars (A) from the access road interact with cars (B, C, etc) on the motorway while weaving together the respective flows, including traffic management system, (TMS), traffic sensors and access equipment, comprising;

a computer based traffic management system being fed with information about flows from various parts of the motorway and its connections to the neighbouring road network, and rations and target values for traffic flows on the accesses and the motorway, being determined and stored with support from the traffic management system, and dynamic corrections being estimated by TMS or by an access equipment, and at least one of (a) and (b) being included;

(a). a sensor being positioned the distance L1 upstream the access weaving zone, measuring the flow continuously and transmitting the traffic information in short time intervals to the TMS and/or the access equipment, (b). an exit equipment including; sensors, detecting cars selecting to take off for the exit, a computer unit, being positioned at the exit equipment or at the TMS, computing or predicting the traffic flow in the right lane downstream the exit, and transmitting traffic information in short time intervals to the TMS and/or the access equipment, an access equipment being positioned at the access, including sensors for traffic measurement and control means for flow control at the access, and rations and correction values are obtained from TMS, or the corrections are estimated from obtained basic values, and the access equipment is managing the corrected access flow, a computer unit in the TMS, the access equipment or a gap-information system is calculating the target values for gaps for the motorway traffic in the right lane, seen over the access flow time period; selectively combined with a gap-information system positioned closely upstream the access along the motorway, the gap-information system informing motorway cars about gaps, based on obtained information.

7. Means according to claim 6, concerning information from cars to road based equipment and means, comprising:

an information transfer including at least one of the following information transfers;

(a). the respective blinker of the car for delivering turning information, video sensor for the road based equipment detecting the turning information, (b) radiowave communication between car and road-based equipment, including transfer or turning information and supplementary information for identification.

8. Means according to claim 6, for carrying out method steps concerning information from road based equipment to selected cars, comprising:

information transfer with a light-lobe, which is controlled by road based equipment and positioned over the car and/or viewable for the driver on or ahead of the car, and including at least one of the following information transfers;

(a). the light has a selected colour, with a meaning according to given colour code, including identity, of which the following are detailed embodiments of given information in the said claims:

(a1) you are the "the colour", (a2) you have the "the role", (a3) you are "(B)-car", (b), the identity colouris connected to the road based information signs with selective information regarding the corresponding indicated identity colour, (c). the position of the light-lobe and at least one of shape and colour give information about the controlled gap, (d) the colour code above is changed to or combined with modulation of the light or infrared "light", which is detected by a car equipment.

9. Means according to claim 6, for carrying out method steps concerning effecting the gap, comprising:

cars equipped with gap controlling equipment, which is fed with information about the gap, and is contributing in effecting the gap.

10. Means according to claim 6, for carrying out method steps concerning prediction or flow control of access traffic, comprising:

cars equipped with speed control equipment, which is used for control of the (A)-car travel plan along the access road, based on information from the road based equipment.

11. Means according to claim 6, for carrying out method steps concerning information from road based equipment selectively to cars along a road, and which means includes presentation means positioned at the side of or above the road, comprising:

selective information is directed to the car concerned; and is activated, when the car ahead isn't seeing the information, and is turned off or changed, when the concerned car no longer is seeing it, and an embodiment is included, where the activity period at dense traffic principally is determined by the respective car passing the information means, selective information is given by one or more repeated presentation means along the road; and at repetition; the content is matched for the respective car travelling from presentation means to presentation means, and whereby information is repeated or successively varied, selective information is presented in at least one of the following ways (a)–(c);

a. by an individual presentation means, b. successively, part by part, utilizing a plurality of presentation means, c. by at least two steps, where the said presentation means information is including an identity information, and where selective additional information is presented by another more general presentation means, which is showing the additional information related to the respective car identity information.

12. Means according to claim 6, comprising:

presentation means presenting selective information, including identifying, according to at least one of;

a. light means, lamps or LED, which are changing colours, or a group of such with different positions and colours, which are switched on in different combinations, (b). showing different patterns or symbols.

13. Means according to claim 6, which have a task including presenting information about gaps, comprising:

presenting information according to at least one of (a)–(d);

a. gaps are illustrated with symbols, where the real given gap is marked related to the status of the recommended gap, the target gap, b. increasing gap is illustrated with symbols, c. static text is indicating gap, and dynamic text or symbols are shown containing the message increase, d. a static sign positioned upstream the presentation means is informing about those latter means.

14. Means according to claim 6, for carrying out method steps concerning exits, and where the means include road constructions including a section of the motorway with its exit, where the motorway section upstream and downstream is connected to the two right lanes of the motorway, where the lane most to the right is called Ri, and the other Le, comprising:

the motorway section is considered divided into at least three stages;

a first stage, where the two said right lanes, Le and Ri, are separated to give space for a lane in between, Int, where the separation starts with a continuous line, or a corresponding separation between Le and Ri, and the line is following Ri, while Le is branching to a continuous Le and Int, and a dotted line, or corresponding separation, is separating Le from Int, and with a traffic function, in which cars in Le can choose the Int lane directly, while cars in Ri have to wait for weaving into Int, until the continuous line is ended, a second stage, where the continuous line separating Ri and Int is changed into a dotted line; and with a traffic function, in which cars from Ri can weave into Int, and later on continue weaving into Le, and cars from Le, now in Int, can weave into Ri, and where Ri is branching to an exit in this stage, or at last in the next (third) stage, a third stage, where Ri is branched into a branch, which is constituting an exit from the motorway, if this wasn't done in stage two, and a branch, which is combined with Int to a lane, which is constituting a continuation of Ri, for connection to the right lane of the motorway, and where the length of the second stage is corresponding to the length of traditional weaving zones, while the other stages can be done shorter, and has the road construction a traffic function, in which cars in respective Le and Ri of the motorway, which want to change lanes, can be performing that in two stages by first changing to an intermediate lane, Int lane, whereby traffic density in Le and Ri are decreasing, and weaving in from Int is simplified, compared with the weaving in dense traffic directly between Le and Ri.

* * * * *

UNITED STATES PATENT AND TRADEMARK OFFICE

CERTIFICATE OF CORRECTION

PATENT NO. : 6,320,515 B1
DATED : November 20, 2001
INVENTOR(S) : Kjell Olsson

It is certified that error appears in the above-identified patent and that said Letters Patent is hereby corrected as shown below:

Column 17, lines 57-67 through Column 18, lines 1-33,
Claim 1 is corrected to read as follows:

1. A method concerning systems for access control of traffic at motorways and larger roads, where the access flow is controlled by information means, which directly or indirectly influence the access travel of the cars, and where the flow size is determined considering the flow size on the motorway, and where cars (A) from the access road interact with cars (B, C, etc) on the motorway while weaving together the respective flows, comprising:

limiting the flow of A-cars on the access road by a given target value, an allocated ration, which is related to a target value for the motorway flow, dynamically correcting said ration based on at least one of the following (a) and (b) and (c);

a. upstream measurements of traffic flow on the motorway, with a correction determined by the deviation between the said flow target value and said measured value, and where the said upstream measurement site is positioned a distance L1 from the access weaving zone, where L1 is that far, that flow-corrected access cars reach the motorway in time for weaving with those motorway cars, which have caused the flow correction, and where a target value for L1 is $L1 \geq v^2 / a$, where v is an applicable velocity value for the motorway and a is an applicable acceleration value for the access, and the quotient $v^2 / a$ is covering (is larger than) the corresponding quotient of velocity and acceleration values for most of the applicable traffic situations, b. at upstream exit, measurements on cars, which indicate exit, a roadbased equipment, which register information about the cars indicating exit, said information is used for estimating a correction of the downstream access flow, c. and the traffic density in the right lane of the motorway, on a distance L2 closest upstream the weaving zone for the access, where L2 is less than L1, is determined within a limit in accordance to that access flow, which is estimated for the weaving together with the said motorway traffic, including determination of target values for gaps between motorway cars, where said target values give a density between cars on the motorway, which seen over the corresponding access flow time period for two consecutive (A)-cars, is corresponding to an added gap for those motorway cars, giving space for at least one car, an access car.

Signed and Sealed this

Twenty-second Day of July, 2003

JAMES E. ROGAN
*Director of the United States Patent and Trademark Office*